United States Patent [19]

Komiyama

[11] Patent Number: 5,062,090

[45] Date of Patent: Oct. 29, 1991

[54] MODULE FOR QUARTZ WATCH

[75] Inventor: Katsuhiko Komiyama, Tokyo, Japan

[73] Assignee: Citizen Watch Co., Ltd., Tokyo, Japan

[21] Appl. No.: 720,598

[22] Filed: Jun. 25, 1991

[30] Foreign Application Priority Data

Jun. 26, 1990 [JP] Japan ..... 2-67729[U]

[51] Int. Cl.[5] ..... G04B 37/00; G04B 1/00

[52] U.S. Cl. ..... 368/88; 368/204

[58] Field of Search ..... 368/76, 80, 88, 203–204, 368/220, 223, 316–318

[56] References Cited

U.S. PATENT DOCUMENTS 4,296,488 10/1981 Nakayama ..... 368/80
4,351,040 9/1982 Aoki ..... 368/88
4,496,246 1/1985 Ota et al. ..... 368/88
4,821,249 4/1989 Ikuma et al. ..... 368/88
4,876,677 10/1989 Moriya ..... 368/87

FOREIGN PATENT DOCUMENTS 57-33436 7/1982 Japan .

OTHER PUBLICATIONS

The Horological Internationl Correspondence vol. 11, No. 127.

*Primary Examiner*—Vit W. Miska
*Attorney, Agent, or Firm*—Koda and Androlia

[57] ABSTRACT

A module for a watch which indicates time based on clock signals generated by a quartz oscillator. The module includes two batteries disposed across a wheel-train. A circuit block has an arm extending to a motor coil through a space between the wheel-train bridge, supporting the wheel-train and one of the batteries. Driving signals are supplied to the coil from the circuit pattern on the arm of the circuit block.

3 Claims, 4 Drawing Sheets

MODULE FOR QUARTZ WATCH

BACKGROUND OF THE INVENTION

1. Field of the Invention

This invention relates to an analog quartz watch which indicates time based on clock signals generated by a quartz oscillator, and more particularly to a module for such an analog quartz watch.

2. Description of the Related Art

Analog watches have been very popular up to now; most of such analog watches use quartz crystals.

Among a variety of watches, especially wristwatches are required to be compact, thin and light in weight.

Usually a module for a wristwatch includes components such as a wheel-train for moving the hands, a motor for driving the wheel-train, and a battery for supplying electric energy to the motor.

The battery for the wristwatch is usually in the shape of a small button. Some button batteries have life span of about two to three years while some have life span of only one year.

Therefore the users have to exchange batteries every two or three years, which is troublesome and expensive.

To solve this inconvenience, there have been developed watches including batteries which can run for five or more years. However in such watches, it is inevitable that the batteries become larger, requiring thicker or larger modules.

This kind of the watches does not satisfy the users' demand for watches which should have a long battery life and should be very thin.

Japanese Utility Model Laid-Open Publication No. SHO 57-33436 proposes a module for a watch in which two small batteries are juxtaposed.

However, when there are two batteries in the module, additional parts should be used so as to electrically connect a circuit block and components on the module by a conventional method. Specifically, components for supplying and receiving electric signals should be positioned near the circuit block. However, when two batteries are located near the circuit block, a motor, for example, is obliged to be located far from the circuit block, which will require an additional part for electrical connection between the circuit block and the motor. In addition, the module would become thicker.

In the wristwatches, the components should be packed very closely in the module so as to make the wristwatches compact and thin and to reduce the components and the cost of production.

No specific arrangement to meet such a demand is disclosed in the foregoing Japanese Utility Model Laid-Open Publication No. SHO 57-33436.

SUMMARY OF THE INVENTION

It is therefore an object of this invention to provide a module for a watch in which one module can provide electrical connection between two batteries and a motor by one circuit block.

According to this invention, a circuit block has an arm extending to an electromagnetic coil of a motor through a space between a wheel-train and one of batteries. Driving signals are supplied to the electromagnetic coil through a circuit pattern on the arm. Therefore the circuit block and two batteries are connected electrically.

With this arrangement, one circuit block is enough to connect the two batteries and the electromagnetic coil by the arm without using a lead wire, for example.

DETAILED DESCRIPTION

A first preferred embodiment of this invention will now be described with reference to FIGS. 1 to 3.

Figure 1:
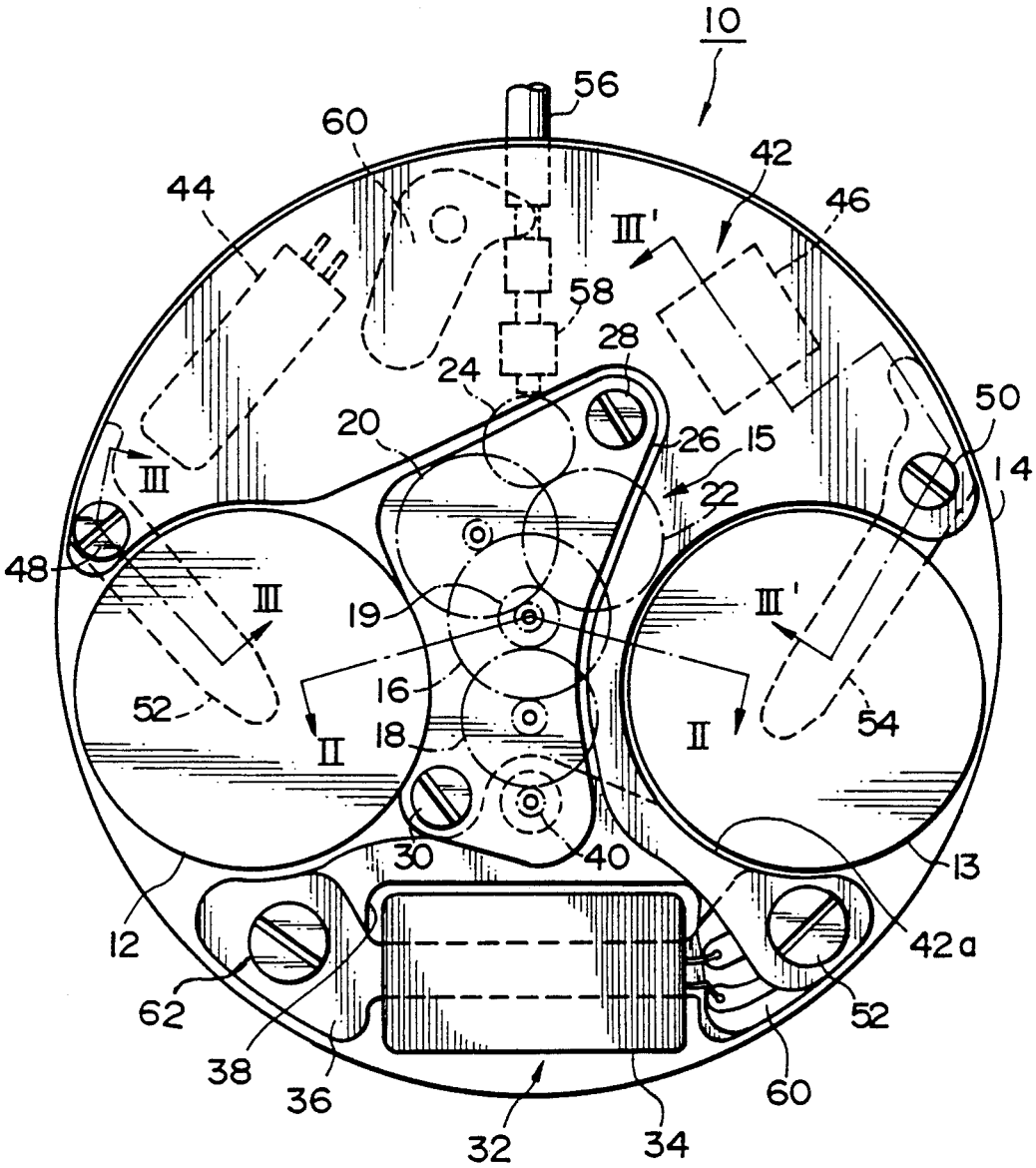
FIG. 1 is a plan view showing the configuration of a module, for a watch, mounted on a side of a main plate confronting a non-dial side, according a first embodiment of this invention.

FIG. 1 shows a module 10 for a wristwatch. Two button batteries 12, 13 are mounted in the module 10. Specifically, the two batteries 12, 13 are mounted on a main plate 14 via insulating sheets 11*a*, 11*b* as shown in FIGS. 2 and 3.

As shown in FIG. 1, some wheels (front wheel-train) 15 (not shown in FIG. 1) for moving non-illustrated hour, minute and second hands is positioned at the center of the main plate 14. Some of wheels (rear wheel-train) (not shown in FIG. 1) in the wheel-train are disposed on a dial confronting side of the main plate.

The wheel-train 15 includes a second wheel 16, a fifth wheel 18, a center minute pinion 19, a third wheel 20, a minute wheel 22, and a setting wheel 24. The wheel-train 15 is similar to that of a conventional analog watch, and is pivotally supported on the main plate 14 and a wheel-train bridge 26.

The wheel-train bridge 26 is made of metal in this embodiment, and is fastened to the main plate 14 by two screws 28, 30.

A motor 32 is positioned on the main plate 14 in the vicinity of the wheel-train 15 (at a lower part in FIG. 1), and includes a coil 34 for generating magnetic force, a core 36 inserted through the coil 34, a stator 38 connected to the core 36, and a rotor 40.

In operation, when a driving signal is applied to the coil 34, magnetic flux flows across the core 36 and the stator 38, thereby causing the rotor 40 to turn by a predetermined angle.

The rotor 40 is in engagement with the fifth wheel 18 to thereby transmit driving force the wheel-train 15 from the motor 32. The rotor 40 is adapted to turn 180° every second. The rotation of the rotor 40 is subject to speed reduction to 1/30, being transmitted to the second wheel 16 for moving the second hand 16.

A circuit block 42 is disposed on in opposite side of the motor 32 via the wheel-train 15. The circuit block 42 includes components such as a quartz oscillator 44 for generating clock signals as a base for time indication, and a control IC 46 for controlling the motor 32. Both the quartz oscillator 44 and the control IC 46 are positioned on the circuit block 42 on its side confronting the dial as shown in FIG. 3. Other components located on the circuit block 42 are not illustrated here for clarity.

As shown in FIG. 1, the circuit block 42 is fastened to the main plate 14 by three screws 48, 50, 52. A plastic spacer 53 is sandwiched between the main plate 14 and the circuit block 42. Specifically, the spacer 53 has holes 53*a*, 53*b* into which the screws 48, 50 threadedly extend via tubes 55*a*, 55*b*. Therefore the circuit block 42 is insulated from the main plate 14.

Figure 4:
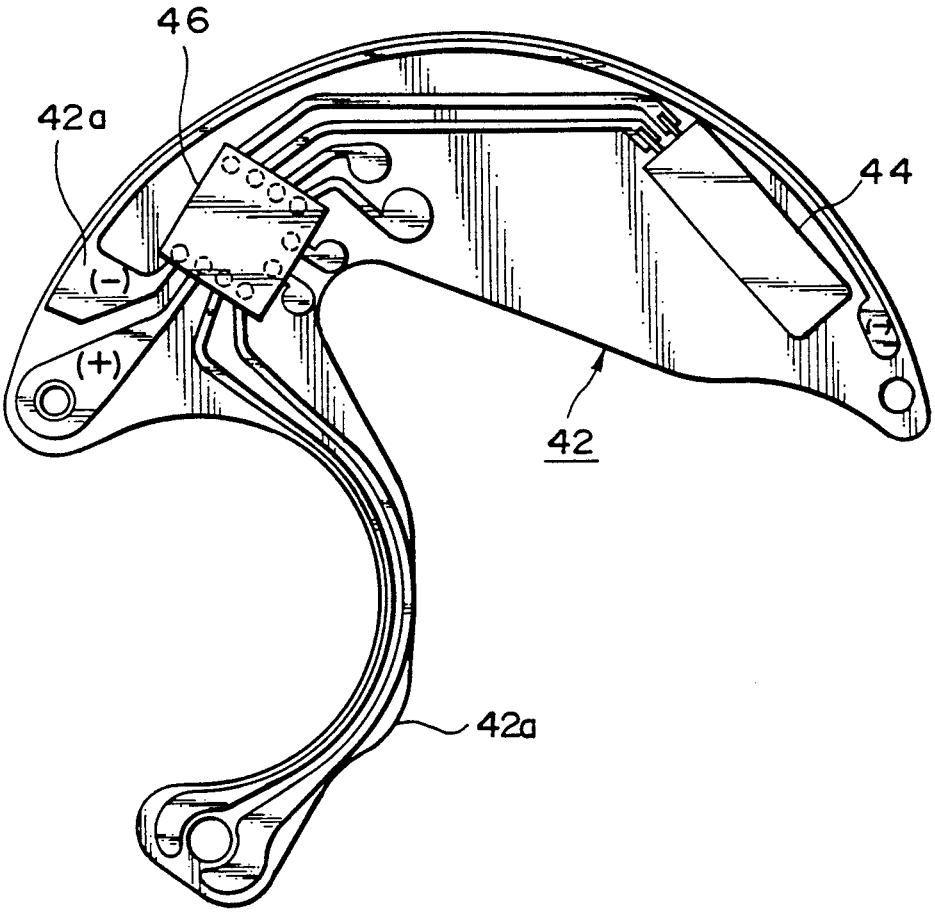
FIG. 4 shows a circuit pattern printed on a circuit block.

As shown in FIG. 4, the circuit block 42 has a circuit pattern 42*a* printed on its side confronting the dial (i.e. on the rear side of the plane of the drawing sheet of FIG. 1).

The module 10 has the two batteries 12, 13 as shown in FIG. 1. Specifically, the batteries 12, 13 are positioned across the wheel-train 15. Two battery springs 52, 54 are provided for electrical connection between the batteries 12, 13 and the circuit block 42. The spring 52, 54 are fastened by the screws 48, 50, respectively.

Figure 3:
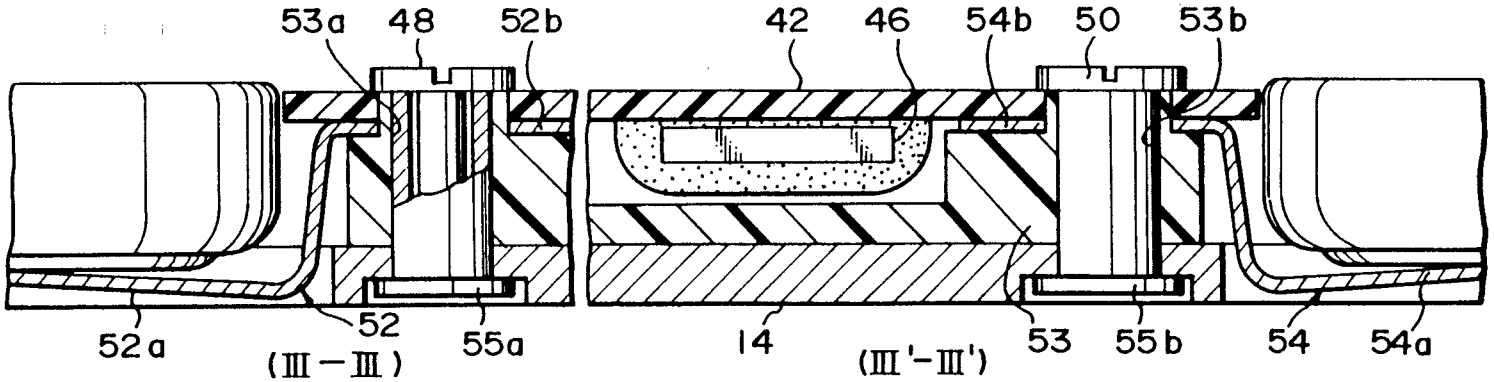
FIGS. 3(A) and 3(B) are cross-sectional views taken along lines III-III and III'-III', respectively, of FIG. 1.

As shown in FIG. 3, an end 52*a* of the spring 52 and an end 54*a* of the spring 54 are connected to cathodes of the batteries 12, 13. The other ends 52*b*, 54*b* of the springs 52, 54 are sandwiched between the circuit block 42 and the spacer 54, thereby attaining electrical connection between the pattern 42*a* and the ends 52*b*, 54*b* of the batteries 12, 13. The cathodes of the two batteries 12, 13 are electrically conductive by the pattern 42*a*.

Anodes of the batteries 12, 13 are electrically conductive by a non-illustrated battery supporting spring similarly to the conventional ones.

The module 10 includes a winding stem 56, an hour wheel 58 and a setting lever 60 for time correction.

The circuit block 42 has an arm 42*a* extending to the coil 34 through a space between the wheel-train bridge 26 and the battery 13. In other words, the circuit block 42 extends partially to the coil 34 for electrical connection between them without using a lead wire. The arm 42*a* can obviate an additional part such as a lead wire for the electrical connection, reduce the number of the components, and facilitate assembling of the module 10.

The end of the arm 42*a*, together with the core 36 and a terminal board 60, is fastened to the main plate 14 by the screw 52. The coil 34 is connected via its opposite ends to the terminal board 60 by soldering, for example. Thus the coil 34 is connected to the pattern printed on the arm 42*a* via the terminal board 60. The other end of the core 36, together with the stator 38, is fastened to the main plate 14 by the screw 62.

Figure 2:
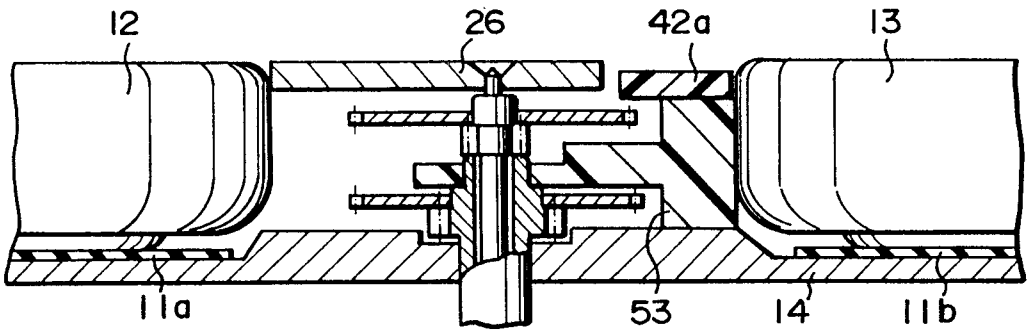
FIG. 2 is a cross-sectional view taken along line II-II of FIG. 1.

As shown in FIG. 2, both the wheel-train bridge 26 and the circuit block 42 are substantially flush with each other. The arm 42*a* is shaped so as not to touch the wheel-train bridge 26.

Figure 5:
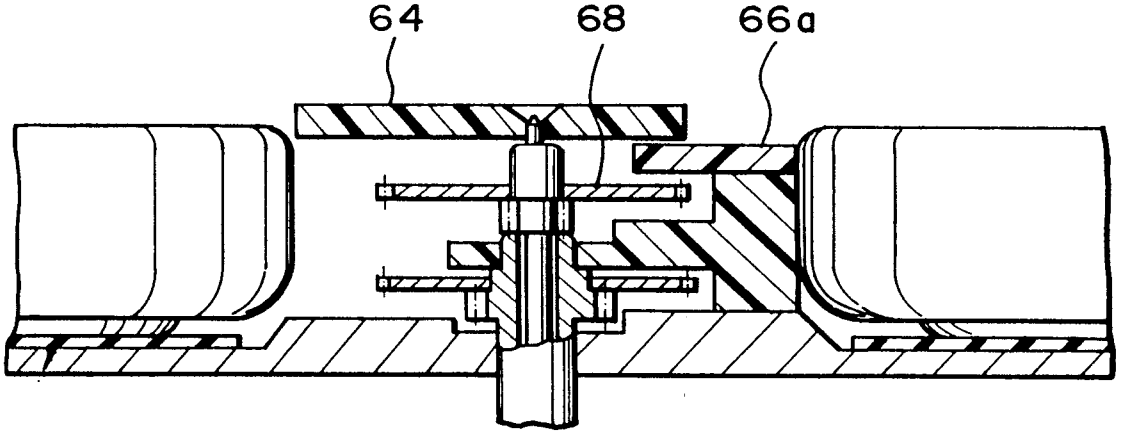
FIG. 5 is a cross-sectional view of a module, for a watch, according a second embodiment.

A second embodiment of this invention is shown in FIG. 5, which is a cross-sectional view similar to FIG. 2.

In the second embodiment, the wheel-train bridge 64 is made of insulating material such as plastics. The wheel-train bridge 64 and the arm 66*a* are located on different levels. Specifically, a part of the arm 66*a* enters the space between the lower surface of the wheel-train bridge 64 and the second wheel 68. This arrangement enables electrical connection between one circuit block and the coil.

According to this invention, since the circuit block has the arm for its electrical connection with the coil, the module does not need additional parts for such connection even when two batteries are used in the module. Therefore the module is thin bus is easy to assemble.

What is claimed is:

1. A module for a quartz watch, comprising:

a main plate;

(b) a wheel-train disposed at a substantially central portion of said main plate;

(c) one wheel-train bridge for pivotally supporting said wheel-train with said main plate;

(d) a motor including an electromagnetic coil driven by pulses and operable to drive said wheel-train;

(e) a circuit block including a quartz oscillator, a control integrated circuit, a printed circuit pattern, and an arm extending to said electromagnetic coil;

(f) two batteries disposed respectively at opposite sides of said wheel-train between said circuit block and said motor; and (g) two battery springs for connecting cathodes of said batteries and said circuit block; wherein said electromagnetic coil, said circuit block and said batteries are superimposed on said main plate substantially without overlapping one another, and said arm extends to said electromagnetic coil through a space between said wheel-train and one of said two batteries to supply driving signals to said electromagnetic coil via a circuit pattern printed on said arm.

2. A module according to claim 1, wherein said circuit block is fastened to said main plate by first, second and third screws, said first screw also fastening one of said battery springs, said second screw also fastening the other battery spring, said third screw also fastening an end of said arm of said circuit block and a core inserted through said coil.

3. A module according to claim 2, wherein cathodes of said batteries are made conductive by said circuit pattern.

* * * * *